US011976375B1

(12) United States Patent
Goodman et al.

(10) Patent No.: US 11,976,375 B1
(45) Date of Patent: May 7, 2024

(54) FRACTURE RESISTANT MOUNTING FOR CERAMIC PIPING

(71) Applicant: Li-Metal Corp., Markham (CA)

(72) Inventors: Jonathan T. Goodman, Evanston, IL (US); Hansdeep Singh, Toronto (CA); Christopher Daniel Boon, New Beith (AU); Maciej Jastrzebski, Toronto (CA)

(73) Assignee: Li-Metal Corp., Markham (CA)

( * ) Notice: Subject to any disclaimer, the term of this patent is extended or adjusted under 35 U.S.C. 154(b) by 0 days.

(21) Appl. No.: 18/183,916

(22) Filed: Mar. 14, 2023

Related U.S. Application Data

(60) Provisional application No. 63/383,403, filed on Nov. 11, 2022.

(51) Int. Cl.
*C25C 7/00* (2006.01)
*C25C 3/02* (2006.01)

(52) U.S. Cl.
CPC ..... *C25C 7/005* (2013.01); *C25C 3/02* (2013.01)

(58) Field of Classification Search
CPC ..... C25C 7/005
USPC ..... 204/260, 272, 241
See application file for complete search history.

(56) References Cited

U.S. PATENT DOCUMENTS 1,501,756 A * 7/1924 James ..... C25C 3/02 205/411
2,924,558 A * 2/1960 Gallinger ..... C25C 7/04 204/260
3,111,745 A 11/1963 Carlisle
3,408,282 A * 10/1968 Frank ..... C25C 7/005 204/260
3,607,684 A * 9/1971 Kuhn ..... C25C 7/04 205/411

(Continued)

FOREIGN PATENT DOCUMENTS

CA 3010198 A1 7/2017
WO 2014152393 A1 9/2014

OTHER PUBLICATIONS

Lessing, Paul, A review of sealing technologies applicable to solid oxide electrolysis cells, Journal of Materials Science, vol. 42, No. 10, Jan. 2007, pp. 3465-3476 (Year: 2007).*

(Continued)

*Primary Examiner* — Harry D Wilkins, III
(74) *Attorney, Agent, or Firm* — Marks & Clerk

(57) ABSTRACT

Systems and processes for the production of lithium metal from molten salts. Systems can include a ceramic tube affixed by or to a freeze-composite. The freeze-composite includes a matrix, of a salt and a dispersed phase. The freeze is maintained with a cooling collar to maintain a temperature below the melting point of the salt. Systems can include a molten-catholyte and a molten-anolyte each adjacent to separate surfaces of the ceramic tube. The freeze-composite forms a fluidic and non-conductive barrier between the molten-catholyte and the molten-anolyte. Processes include a freeze-composite affixed to the ceramic tube. The ceramic tube is adjacent to a composite collar which is adjacent to a cooling collar; The cooling fluid is passed through the cooling collar. A molten-catholyte is passed along a first surface of the ceramic tube. A molten-anolyte is passed along to a second surface of the ceramic tube.

13 Claims, 3 Drawing Sheets

(56) References Cited

U.S. PATENT DOCUMENTS

| | | | | |
|---|---|---|---|---|
| 3,962,064 | A | 6/1976 | Brut | |
| 4,089,770 | A | 5/1978 | Lemke | |
| 4,092,228 | A | 5/1978 | Ross | |
| 4,108,743 | A | 8/1978 | Minck | |
| 4,186,049 | A * | 1/1980 | Blum | G21C 13/0875 976/DIG. 200 |
| 4,256,551 | A | 3/1981 | Cliff | |
| 4,455,202 | A | 6/1984 | Sintim-Damoa | |
| 4,592,821 | A * | 6/1986 | Keinborg | C25C 3/16 204/247.1 |
| 4,617,098 | A | 10/1986 | Verdier | |
| 4,740,279 | A | 4/1988 | Muller | |
| 4,780,186 | A | 10/1988 | Christini et al. | |
| 4,790,917 | A | 12/1988 | Dewing | |
| 4,849,072 | A | 7/1989 | Bowman | |
| 4,882,017 | A | 11/1989 | Weaver | |
| 4,973,390 | A | 11/1990 | Christini et al. | |
| 4,988,417 | A | 1/1991 | Deyoung | |
| 5,131,988 | A | 7/1992 | Peterson | |
| 5,951,843 | A | 9/1999 | Itoh | |
| 6,063,247 | A * | 5/2000 | Bergmann | C25C 7/005 204/243.1 |
| 6,086,733 | A | 7/2000 | Carey | |
| 6,368,486 | B1 | 4/2002 | Thompson | |
| 7,897,023 | B2 | 3/2011 | Bakhir | |
| 8,715,482 | B2 | 5/2014 | Amendola et al. | |
| 11,174,562 | B2 * | 11/2021 | But | C25B 13/02 |
| 2003/0094379 | A1 | 5/2003 | Jacobson | |
| 2004/0194574 | A1 * | 10/2004 | Cardarelli | C25C 3/28 205/400 |
| 2005/0100793 | A1 | 5/2005 | Jonghe | |
| 2006/0144701 | A1 * | 7/2006 | Kelly | C25C 7/005 205/345 |
| 2007/0246368 | A1 | 10/2007 | Huber | |
| 2008/0054629 | A1 * | 3/2008 | Sawanura | B01D 61/362 285/290.5 |
| 2011/0135565 | A1 * | 6/2011 | Bingham | C01B 3/06 423/657 |
| 2012/0006690 | A1 | 1/2012 | Amendola | |
| 2012/0241314 | A1 | 9/2012 | Madono | |
| 2014/0131217 | A1 * | 5/2014 | Buschmann | C01B 11/062 205/633 |
| 2015/0014184 | A1 | 1/2015 | Swonger | |
| 2015/0041311 | A1 | 2/2015 | Mathe | |
| 2015/0129432 | A1 | 5/2015 | Wright | |
| 2015/0211135 | A1 | 7/2015 | Fan | |
| 2016/0251764 | A1 * | 9/2016 | Iltsenko | C25B 1/26 204/260 |
| 2018/0187317 | A1 | 7/2018 | Gordon | |
| 2019/0048483 | A1 | 2/2019 | Swonger et al. | |
| 2020/0181783 | A1 * | 6/2020 | But | C25B 15/02 |
| 2020/0399772 | A1 | 12/2020 | Kiggins et al. | |
| 2023/0119799 | A1 * | 4/2023 | Jastrzebski | C25C 7/06 204/274 |
| 2023/0167565 | A1 * | 6/2023 | Jastrzebski | C25C 7/007 205/407 |

OTHER PUBLICATIONS

Sekiguchi et al., Thermodynamic analysis of molten alkali halide mixtures by molecular dynamic simulations, Journal of Molecular Liquids, vol. 315, Oct. 2020, 113758 pp. 1-7 (Year: 2020).

Sridharan et al., Thermal Properties of LiCI-KCI Molten Salt for Nuclear Waste Separation, OSTI.gov Technical Report, available online at https://www.osti.gov/biblio/1058922, Nov. 2012, pp. 1-111 (Year: 2012).

The International Search Report and Written Opinion dated Apr. 14, 2022 for PCT/CA2022/050095.

The International Search Report and Written Opinion dated Apr. 21, 2022 for PCT/CA2022/050093.

The International Search Report and Written Opinion dated May 3, 2023 for PCT/CA2022/050092.

Office action issued by CIPO on Dec. 11, 2023 in relation to CA 3,183,962.

European Search Report issued Jan. 4, 2024 in respect of EP 40004260.

* cited by examiner

FRACTURE RESISTANT MOUNTING FOR CERAMIC PIPING

CROSS-REFERENCES TO RELATED APPLICATIONS

The present application claims the benefit of U.S. Provisional Application No. 63/383,403 filed Nov. 11, 2022.

FIELD OF THE INVENTION

The present invention is directed toward the mounting and operation of ceramic materials in molten salts.

BACKGROUND

Molten salt electrolysis has been widely practiced for over a hundred years, including the Hall-Heroult process for aluminum, the Dow and IG Farben processes for magnesium, and the Downs process for alkali metals. The majority of commercial-scale molten salt electrolytic processes use chloride or fluoride electrolytes, as these are solvents which facilitate the electrowinning of the target metals from their oxides, chlorides, or other compounds. In many cases, the electrolyte, or the oxide, chloride, or fluoride of the desired product metal, have either physical properties that are undesirable (e.g., toxic, hygroscopic, corrosive, etc.) or are disadvantageous for other reasons (cost, availability, security of supply, competing uses, difficulty of manufacture, etc.).

U.S. Pat. No. 3,607,684 discloses a process for the manufacture of alkali metal by passing an electrolyzing current from an anode to a cathode. The anode is in contact with a fused metal halide salt comprising ions of the alkali metal and no other monovalent cations. The cathode is in the form of liquid alkali metal. Interspersed between the anode and the cathode is a diaphragm. The diaphragm is polycrystalline ceramic material which has ions of the alkali metal or ions capable of being replaced by the alkali metal. The diaphragm is permeable only to monovalent cations and therefore will pass only the cations of the alkali metal which is being manufactured. Halogen can be recovered as the anode product or a halogenated hydrocarbon can be recovered as the anode product by introducing a hydrocarbon or partially halogenated hydrocarbon into the anode compartment.

U.S. Pat. No. 1,501,756 discloses a process of producing alkali metals and halogens by electrolysis of fused halide baths, as for example, sodium chloride. An object of the invention is to recover halogens containing practically no gaseous impurities.

U.S. Pat. No. 4,988,417 discloses a method of electrolytically producing lithium includes providing an electrolytic cell having an anode compartment and a cathode compartment. The compartments are separated by a porous electrically nonconductive membrane which will be wetted by the electrolyte and permit migration of lithium ions therethrough. Lithium carbonate is introduced into the anode compartment and produces delivery of lithium ions from the anode compartment to the cathode compartment where such ions are converted into lithium metal. The membrane is preferably a non-glass oxide membrane such as a magnesium oxide membrane. The membrane serves to resist undesired backflow of the lithium from the cathode compartment through the membrane into the anode compartment. Undesired communication between the anode and cathode is further resisted by separating the air spaces thereover. This may be accomplished by applying an inert gas purge and a positive pressure in the cathode compartment. The apparatus preferably includes an electrolytic cell with an anode compartment and a cathode compartment and an electrically nonconductive membrane which is wettable by the electrolyte and will permit migration of the lithium ion therethrough while resisting reverse passage of lithium therethrough.

SUMMARY

A first aspect of the invention is directed to an electrolytic system. The electrolytic system includes a ceramic tube. A cooling collar is disposed about and spaced apart from a portion of the ceramic tube. A freeze-composite matrix that includes a salt and a dispersed phase is disposed between and in contact with the ceramic tube and the cooling collar. In one aspect of the invention, the freeze-composite matrix is affixed to the ceramic tube and the cooling collar. In operation, the cooling collar causes the freeze-composite matrix to form a barrier between the cooling collar and the ceramic tube.

A further aspect of the invention is an electrolytic system that includes a ceramic tube. The ceramic tube includes a surface on an outside of the ceramic tube and a surface on the interior of the ceramic tube opposite the exterior. A freeze-composite matrix, which includes a salt and a dispersed phase is disposed between a cooling collar that, in operation maintains a temperature of the freeze-composite matrix below the melting point of the salt. A molten-catholyte is disposed adjacent to one of the interior and the exterior surface of the ceramic tube; a molten-anolyte is disposed adjacent to the other of the interior and exterior surface of the ceramic tube; and the freeze-composite matrix, when cooled, forms a fluidic and non-conductive barrier between the molten-catholyte and the molten-anolyte.

A further aspect of the invention is a process that includes providing a precursor system wherein a ceramic tube is positioned adjacent to a fibrous collar. The fibrous collar is positioned adjacent to a cooling collar. The fibrous collar is saturated with molten salt (i.e., a liquid phase of a salt composition that is at a temperature greater than the salt composition melting point). A cooling fluid is passed through the cooling collar, thereby forming a freeze-composite which is affixed to or caused to become in sealing engagement with the ceramic tube and the cooling collar and that includes a matrix of a frozen salt and a fibrous dispersed phase.

Yet another aspect of the invention is a process that includes providing a precursor system wherein a ceramic tube is positioned adjacent to a composite collar which is positioned adjacent to a cooling collar; passing a cooling fluid through the cooling collar; and thereafter flowing a molten-catholyte along a first surface of the ceramic tube; and flowing a molten-anolyte along a second surface of the ceramic tube.

BRIEF DESCRIPTION OF THE FIGURES

For a more complete understanding of the disclosure, reference should be made to the following detailed description and accompanying drawing figures wherein.

DETAILED DESCRIPTION

Objects, features, and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

Herein, the use of the word "a" or "an" when used in conjunction with the term "comprising" in the claims and/or the specification may mean "one," but it is also consistent with the meaning of "one or more," "at least one," and "one or more than one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or." Furthermore, the transitional phrase "consisting essentially of" limits a scope to the specified materials or steps and those that do not materially affect basic and novel characteristic.

Herein are described electrolytic systems and processes configured for the production of lithium metal from lithium salts. A first embodiment is an electrolytic system that includes a ceramic tube affixed to, in contact with, or at least in close operational association with a freeze-composite that is affixed to, in contact with, or at least in close operational association with a cooling collar. The freeze-composite is in the form of a matrix, which features an admixture of a salt, and a dispersed phase. The cooling collar, in operation, functions to maintain a temperature below the melting point of the salt.

Figure 1:
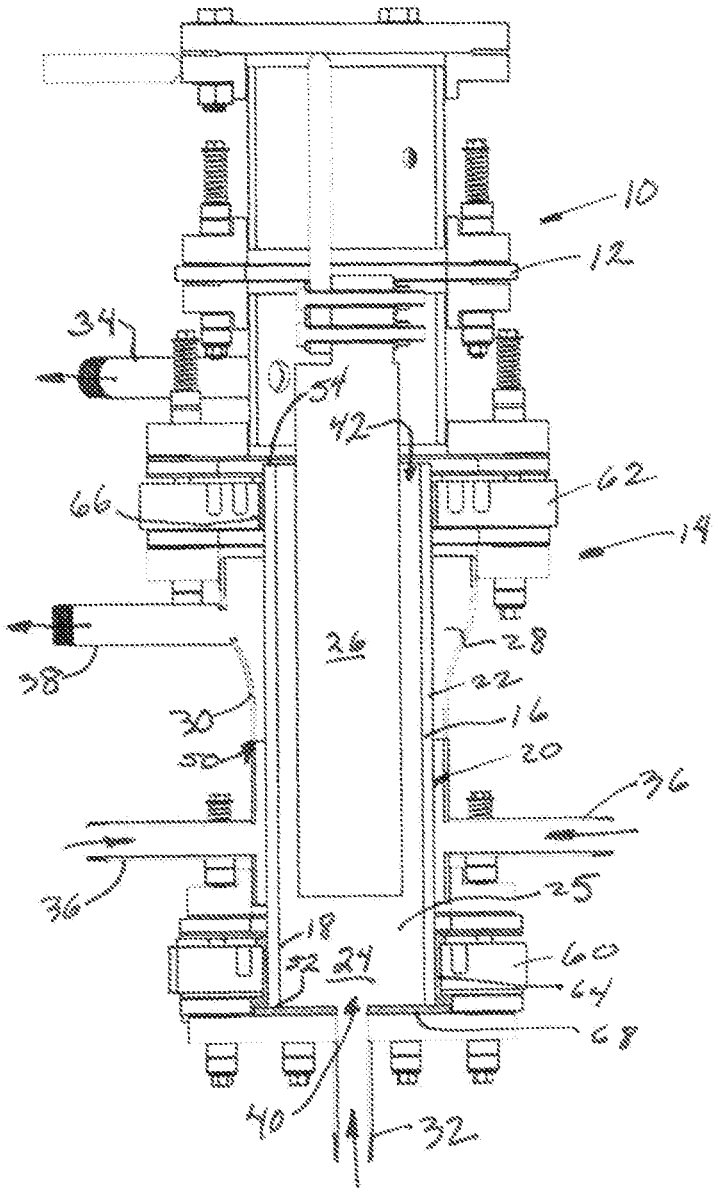
FIG. 1 is a cross section view of an electrolytic system incorporating a freeze-composite matrix according to an aspect of the invention.

An illustrative example of an electrolytic system according to aspects of the invention is shown in FIG. 1. The electrolytic system 10 includes a housing assembly 12 that houses and operatively supports an electrolytic cell 14. It will be understood that the housing assembly 12 may be constructed with well-known structures and materials and may take various forms suitable for housing the necessary elements and operation of an electrolytic system. Also, for purposes of the disclosure, directional references, such as upper and lower, interior and exterior, for example, will be set out and understood according to the orientation of the illustrated structures as depicted in the attached drawings and are not to be taken as limitations.

The electrolytic cell 14 generally operates according to known principles. In the illustrated example, the electrolytic cell 14 includes a ceramic tube 16, which may be located generally within the electrolytic system 10. The ceramic tube 16, which may also be referred to as a membrane herein, may extend vertically within the electrolytic system 10, and includes an inner wall 18, which extends cylindrically about an interior 20 of the tube. The ceramic tube 16 includes an outer wall 20, opposite the inner wall 18, that extends about an exterior 22 of the ceramic tube.

The inner wall 18, in part, defines an inner chamber 24 of the ceramic tube 16 within which an electrode 26 is positioned, which, in this example, may be a cathode. An inner volume 25 of the inner chamber 24, i.e., the portion of the inner chamber not occupied by the electrode 26, is provided with a catholyte in a molten form, which will be referred to herein as the molten catholyte. The electrolytic cell 14 includes an outer volume 28 outside the ceramic tube 16 which is defined, in part, between the outer wall 18 and, in this example, a collar 30 that surrounds and is spaced apart from the outer wall. The collar 30, in this example, operates as the anode portion of the electrolytic cell 14. The outer volume 28 is provided with an anolyte in a molten form, which will be referred to herein as the molten anolyte.

The inner volume 25 is in communication with a source (not shown) of molten catholyte via a catholyte fluid inlet 32 of the electrolytic system 10 for permitting molten catholyte to enter the inner volume. A catholyte fluid outlet 34 of the electrolytic system 10 permits the egress of fluid materials from the inner volume 25.

In the illustrated electrolytic system 10, molten catholyte enters the inner volume 25 via the catholyte fluid inlet 32 at or near a bottom opening 40 of the ceramic tube 16, which bottom opening is the opening of the tube at or near the lower end of the tube in the figure. Fluid material exiting the inner volume 25 leaves the inner volume via the catholyte fluid outlet 34, which in the figure is the top opening 42 of the ceramic tube 16, wherein the top opening is located opposite the bottom opening of the tube. Fluid material exits the top opening 42 and exits the electrolytic system 10 via the catholyte fluid outlet 34. Other flow directions are contemplated.

The outer volume 28 is in communication with a source (not shown) of molten anolyte via an anolyte fluid inlet 36 of the electrolytic system 10 for permitting molten anolyte to enter the outer volume. An anolyte fluid outlet 38 of the electrolytic system 10 permits the egress of fluid materials from the outer volume 28.

In the illustrated electrolytic system 10, molten anolyte enters the outer volume 28 via the anolyte fluid inlet 36, formed through the collar 30 or an adjacent part of the housing assembly 12 near a lower portion 50 of the collar. Fluid material exiting the outer volume 28 leaves the outer volume via the anolyte fluid outlet 38, which in the figure is located vertically above the anolyte fluid inlet 36.

The ceramic tube 16 may have a cylindrical shape as noted above, with a lower opening defined by a lower terminus 52 and an upper opening defined by an upper terminus 54. It will be understood that the ceramic tube 16 is constructed of a material, as is known, that enables the desired molten salt electrolysis process to be conducted with the electrolytic system 10 according to the illustrated example and others.

The electrolytic system 10 includes at least one cooling collar 60, and in one embodiment, a first cooling collar 60 and a second cooling collar 62. The first cooling collar 60 may be positioned concentrically about the ceramic tube 16 at or near the lower terminus 52 and the second cooling collar 62 may be positioned concentrically about the ceramic tube at or near the upper terminus 54. The first cooling collar 60 and the second cooling collar 62 are spaced apart from the ceramic tube 16 so as to provide respective spaces defined therebetween in which spaces freeze-composite matrix is disposed. The cooling collars 60, 62 are both hollow toroidal structures may be in the shape of a rectangle-section ring, which is configured to be provided with a coolant, which when circulated therethrough operates to cool the collars and structural elements of the electrolytic system 10 sufficiently near the collars to be cooled thereby. In an aspect of the invention, the cooling collars 60, 62 are placed into contact with the structures intended to be cooled, and according to the invention, these structures are elements of the electrolytic system 10 made of the freeze-composite matrix detailed herein.

The freeze-composite matrix, the compositions of which will be discussed in detail hereinbelow, is disposed about the ceramic tube 16 and adjacent to and in contact with the cooling collars 60, 62. A first freeze-composite matrix barrier 64 is a generally cylindrical sleeve structure that extends longitudinally from the lower terminus 52 vertically upwardly, referencing the orientation thereof depicted in FIG. 1 along a length of the ceramic tube 16. The first cooling collar 60 has a shape and size to surround and be in contact with the first freeze-composite matrix barrier 64 and, when in operation, functions to cool the first freeze-composite matrix of the first freeze-composite matrix barrier.

A second freeze-composite matrix barrier 66 is a generally cylindrical sleeve structure that extends longitudinally from the upper terminus 54 vertically downwardly, referencing the orientation thereof depicted in FIG. 1 along a length of the ceramic tube 16. The second cooling collar 62 has a shape and size to surround and be in contact with the second freeze-composite matrix barrier 66 and, when in operation, the second cooling collar functions to cool the first freeze-composite matrix of the first freeze-composite matrix barrier.

An optional third barrier 68 is a generally flat, washer-shaped structure that is positioned underneath the ceramic tube and between the ceramic tube and the housing assembly 12 and in an abutting relationship with the lower terminus 52 to support and isolate the ceramic tube from the housing assembly. The third barrier 68 may be constructed of a third freeze-composite matrix material or may be constructed of a cushion comprising a plurality of inorganic fibers.

As will be discussed in more detail herein, the first and second freeze-composite matrix barriers 64, 66 function to one or more of position, carry, resiliently cushion, or provide sealing with respect to the ceramic tube and the housing assembly 12 and further functions to isolate the inner volume 25 from the outer volume 28. In one embodiment, the third barrier 68 may also function to one or more of position, carry, resiliently cushion, or provide sealing. Other benefits of one or more of the first, second, and third barriers 64, 66, or 68 are contemplated. In addition, the first and third barrier 64, 68 may be a single-piece construction or constructed as two, separate elements.

In a first example, freeze-composite matrix includes a dispersed phase that includes an inorganic material, preferably a plurality of inorganic fibers. These inorganic fibers can be silicate fibers, aluminate fibers, aluminosilicate fibers, or a mixture of these fibers. In another instance, the inorganic fibers can be selected from a silicate, an aluminate, an aluminosilicate, and a mixture thereof. The dispersed phase can be a refractory fiber, for example, selected from a ROCKWOOL, a KAOWOOL, a KAOWOOL high purity, a CERAFIBER, a CERACHEM, a CERACHROME, a SAFFIL, or a mixture thereof. In another instance, the dispersed phase can include a particulate, for example an inorganic material with a particle size (diameter) of greater than about 250 microns and less than about 5 mm, preferably greater than about 250 microns and less than about 4 mm, 3 mm, 2 mm, or 1 mm; more preferably greater than about 300 microns, 350 microns, 400 microns, 450 microns, or 500 microns and less than about 5 mm.

Still further, the dispersed phase can include a mat or nonwoven sheet of the inorganic material, preferably an inorganic fiber mat or sheet. More preferably, the dispersed phase is disposed concentrically about the ceramic tube 16. In one example, the dispersed phase is adapted from a fibrous collar adjacent to the ceramic tube 16. The fibrous collar 16 can be adapted from a mat or sheet of the inorganic material.

Herein, the freeze-composite matrix is, preferably, sized and shaped to carry the ceramic tube 16 in the electrolytic system 10. In one instance, the freeze-composite matrix is adhered to the ceramic tube 16, for example, the freeze-composite matrix can be frozen to the ceramic tube. The adhesion of the freeze-composite matrix to the ceramic tube can be physical or chemical adhesion. In one preferable example, a portion of the salt portion of the third freeze-composite matrix penetrates the ceramic tube 16 and forms a solid network with the salt of the freeze-composite matrix.

In another instance, the fibrous collar portion can extend beyond the freeze-composite. That is, the inorganic fibers can individually be within and outside of the freeze-composite matrix. In one functional example, the freeze-composite matrix is adjacent to molten salt and the inorganic fibers can extend from the matrix into a molten volume. In another instance, the fibrous collar can be adjacent to a terminus 52 of the ceramic tube 16. In yet another instance, a terminus 52 of the ceramic tube 16 is adjacent to a barrier 68 comprising a cushion comprising a plurality of inorganic fibers. Herein, the cushion can be adjacent to or proximal to the freeze-composite such that inorganic fibers can extend from the matrix into the cushion, or the cushion can be separate or distal from the freeze-composite such that molten salt might be present between the two.

In a preferable instance, electrolytic system 10 includes an anolyte in the inner volume 25 and a catholyte in the outer volume 28. Herein, anolyte and catholyte carry their common meanings of being adjacent to an anode and cathode, respectively. The outer volume 28 is sized and shaped to carry an anolyte material adjacent to the anode (see 30 in FIG. 1) and the inner volume 25 is adapted to carry a catholyte material adjacent to the cathode (see 26 in FIG. 1). In certain instances, the respective volumes are separated by a membrane, for example in a battery the respective volumes are separated by a separator, a porous ion-conductive membrane. Herein, the function of such a membrane is provided by the ceramic tube 16, and the freeze-composite matrix separates the anolyte volume from the catholyte volume, thereby preventing ionic and/or electronic conductivity between the anolyte (outer) volume and the catholyte (inner) volume. The freeze-composite matrix prevents fluidic conductivity between the anolyte volume and the catholyte volume.

In another example, the salt comprises an admixture of lithium chloride and potassium chloride. In a preferable instance, the salt includes, consists essentially of, or consists of LiCl and KCl; specifically, a eutectic admixture thereof, also called a eutectic. While a eutectic admixture is commonly known to be a specific composition with a precise melting point that is lower than adjacent compositions, herein, the term eutectic is used to refer to a composition within about 10%, 5%, or 1% of the lowest melting point (eutectic point). That is, a eutectic is a mixture of substances (in proportions within about 10 wt. %, 5 wt. %, or 1 wt. % of a eutectic point) that melts and solidifies at a temperature that is lower than the melting points of the separate constituents or of any other mixture of them, non-eutectic(s) (e.g., mixtures with proportions greater than 15 wt. % from the eutectic point).

The salt can include about 50 wt. % to about 70 wt. % LiCl, about 50 wt. % to about 65 wt. % LiCl, or about 55 to about 65 wt. % LiCl. In one specific instance, the salt includes about 58 wt. % LiCl. In other instances, the salt includes about 57 wt. % to 59 wt. % LiCl, about 55 wt. % to about 61 wt. % LiCl, or about 52 wt. % to about 64 wt. % LiCl. Preferably where the balance of the composition is KCl. Even more preferably, the salt has a melting point of about 350° C. to about 450° C., about 350° C. to about 425° C., about 350° C. to about 400° C., or about 350° C. to about 375° C. Notably, the LiCl—KCl eutectic has a melting point of about 352° C. and the compositions of the salt herein can have a melting point from the eutectic melting point of 352° C. to about 450° C., about 425° C., about 400° C., about 375° C., about 370° C., about 365° C., about 360° C., or about 355° C.

In separate preferable instance, the salt can be a non-eutectic. That is, the salt can have a composition that is distal from the LiCl—KCl eutectic composition. In one example, the salt has a melting point greater than about 450° C., about 475° C., about 500° C., about 525° C., or 550° C. By way of composition, the salt can include greater than about 50 wt. %, about 55 wt. %, about 60 wt. %, about 65 wt. %, about 70 wt. %, about 75 wt. %, about 80 wt. %, about 85 wt. %, or about 90 wt. % KCl. In another instance, the salt can include greater than about 65 wt. %, about 70 wt. %, about 75 wt. %, about 80 wt. %, about 85 wt. %, or about 90 wt. % LiCl. The non-eutectic salt composition can be a homogeneous or heterogeneous admixture of LiCl and KCl. The non-eutectic salt composition can further include, consist essentially of, or consist of lithium chloride and potassium chloride. Another embodiment, also referring to FIG. 1, of an electrolytic system 10 includes a ceramic tube 16 affixed to one or more barrier 64, 66, 68 constructed of the disclosed freeze-composite matrix. The freeze-composite matrix includes a salt and a dispersed phase, and is preferably affixed to a cooling collar 60, 62, the cooling collars configured to maintain a temperature below the melting point of the salt. This embodiment further includes a molten-catholyte adjacent to an inner wall 18 of the ceramic tube 16 and a molten-anolyte adjacent to an outer wall 20 of the ceramic tube. Accordingly, the freeze-composite matrix provides a barrier, preferably a fluidic and non-conductive barrier, between the molten-catholyte and the molten-anolyte. In one example, the molten-catholyte includes an admixture of LiCl and KCl and has a melting point below about 425° C.; and the molten-anolyte includes an admixture of LiCl and KCl and has a melting point below about 425° C. The melting point of the molten-catholyte is, preferably, about of 352° C. to about 425° C., about 400° C., about 375° C., about 370° C., about 365° C., about 360° C., or about 355° C. The melting point of the molten-anolyte is, preferably, about of 352° C. to about 425° C., about 400° C., about 375° C., about 370° C., about 365° C., about 360° C., or about 355° C.

The salt can have a melting point approximately the same as that of the catholyte and/or anolyte or can be different from one or both the catholyte and/or anolyte. In one instance, the salt includes an admixture of LiCl and KCl and has a melting point below about 425° C., or has a melting point of about 352° C. to about 450° C., about 425° C., about 400° C., about 375° C., about 370° C., about 365° C., about 360° C., or about 355° C. In another instance, the salt includes an admixture of LiCl and KCl and has a melting point above about 450° C., about 475° C., about 500° C., about 525° C., or about 550° C.

Figure 2:
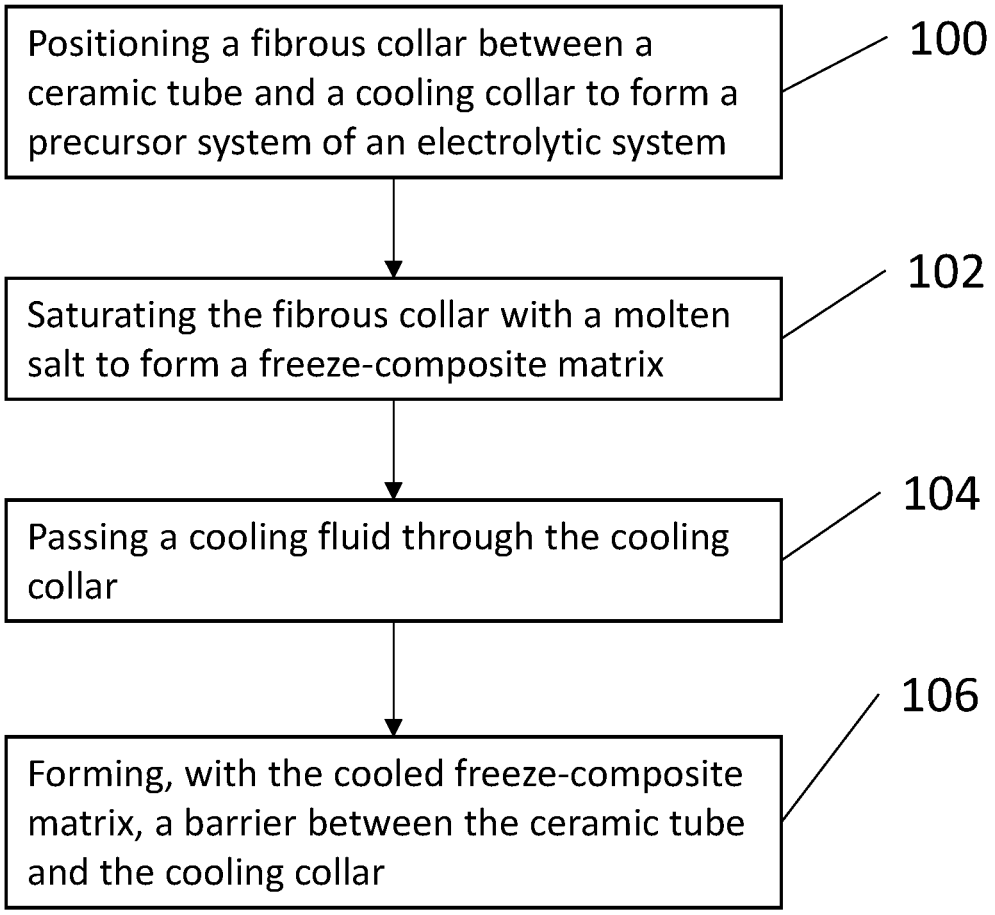
FIG. 2 is a flow chart illustrating steps of a process according to an aspect of the invention.

Yet another embodiment, referring to FIG. 2 and also FIG. 1, is a process that includes assembling a precursor system wherein a fibrous collar (one or more of 64, 66, 68) is positioned adjacent to and between a cooling collar (one or both of 60, 62) and a ceramic tube 16 (step 100); saturating the fibrous collar with molten salt (i.e., the liquid phase of a salt composition that is at a temperature greater than the salt composition melting point) (step 102); applying or passing a cooling fluid through the cooling collar (step 104); and thereby forming a freeze-composite (step 106) which may be caused thereby to become affixed to the ceramic tube and the cooling collar and that includes a matrix of a frozen salt and a fibrous dispersed phase.

The process can include applying cooling fluid to the cooling collar 60, 62 prior to saturating the fibrous collar with molten salt, or saturating the fibrous collar with molten salt and then applying cooling fluid to the cooling collar. In an instance, for example wherein the fibrous collar provides little to no resistance to flow between a catholyte volume 25 and an anolyte volume 28, cooling fluid is applied to the cooling collar 60, 62 prior to saturating with the molten salt thereby freezing the molten salt into the freeze-composite and preventing outflow of the molten salt from the fibrous collar.

The cooling fluid can be a dry gas carried through the cooling collar. The gas can be carried at a rate of at least 1 CFM, 2 CFM, 3 CFM, 4 CFM, 5 CFM, 7.5 CFM, 10 CFM, 15 CFM, 20 CFM or 25 CFM; in another example, the gas can be provided at a temperature less than about 200° C., 150° C., 100° C., 75° C., 50° C., 25° C., 20° C., 15° C., 10° C., 5° C., or 0° C.

In another instance, the step of applying the cooling fluid included passing a first cooling fluid through the cooling collar and then passing a second cooling fluid through the cooling collar. The first cooling fluid can be selected from a gas, a liquid, or a mixture thereof. The second cooling fluid can be independently selected from a gas, a liquid, or a mixture thereof. In one example, the first cooling fluid is a gas and the second cooling fluid is a liquid. In another example, the first and the second cooling fluids are gases. In a third example, the first cooling fluid is a gas and the second cooling fluid is a mixture of a gas and a liquid.

The process can further comprise providing a fibrous collar. In one instance, the fibrous collar is batting, or a mass shaped into a collar, in another instance, the fibrous collar is cut from a sheet of mat of an inorganic material. By way of example, the fibrous collar can be cut from a Kaowool blanket or sheet or a RockWool sheet, notably both products KAOWOOL and ROCKWOOL are provided as semi-rigid boards (sheets) for insulation purposes and can be cut to provide a fibrous collar. Thereafter, the process can further include positioning the fibrous collar about the ceramic tube; and then positioning the ceramic tube carrying the fibrous collar within the cooling collar. In one example, the fibrous collar is toroidal; preferably wherein the fibrous collar is a torus or a rectangular toroid. In another example, the fibrous collar is a ring or L-shaped toroid that fits adjacent to an end of the ceramic tube.

Figure 3:
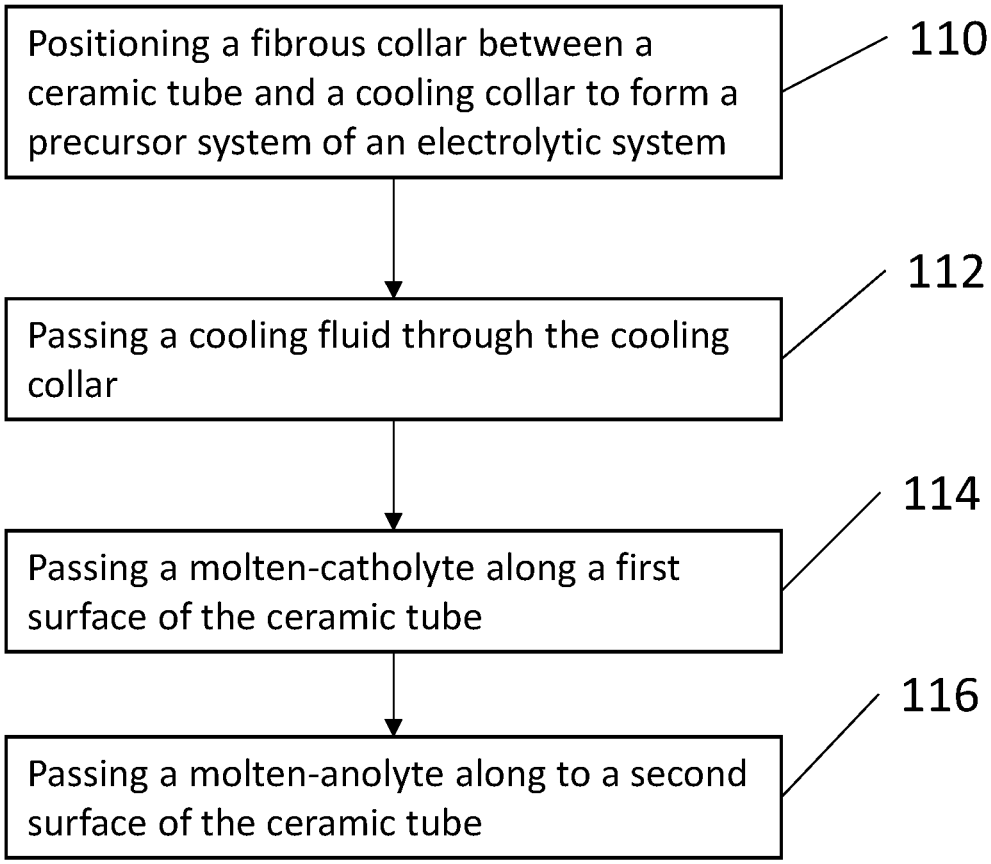
FIG. 3 is a flow chart illustrating steps of a process according to an alternative aspect of the invention. While specific embodiments are illustrated in the figures, with the understanding that the disclosure is intended to be illustrative, these embodiments are not intended to limit the invention described and illustrated herein.

Still further, and referring to FIG. 1 and FIG. 3, the process can include positioning a ceramic tube 16 adjacent to and spaced apart from a cooling collar 62, 62 and positioning a composite collar 64, 66, 68 between the ceramic tube and the cooling collar to form a precursor system (step 110); passing a cooling fluid through the cooling collar (step 112); flowing a molten-catholyte along a first surface 18 of the ceramic tube (step 114); flowing a molten-anolyte along a second surface 20 of the ceramic tube (116). The freeze-composite provides a fluidic and non-conductive barrier 62, 64, 66 between the molten-catholyte and the molten-anolyte. That is, the freeze-composite preferably separates the catholyte and the anolyte volumes 25, 28 from fluidic, ionic, and electronic mobility between the volumes. Notably, the ceramic tube 16 may permit fluidic, ionic, and/or electronic mobility between the volumes 25, 28 external to the freeze-composite or freeze volume.

Individually, the molten-catholyte and the molten-anolyte can include an admixture of LiCl and KCl. Preferably, the melting point of the molten-catholyte and/or the molten-anolyte (specifically, the melting point of the eutectic compositions that comprise the molten-catholyte and the molten-anolyte) is below about 425° C., 400° C., or 375° C. Herein, the fibrous collar can include a salt composition that is the same as or similar to that of the molten-catholyte and/or the molten-anolyte. In one instance, the fibrous collar can include a salt composition that is an admixture of LiCl and KCl and has a melting point below about 425° C. In another instance, the fibrous collar can include a salt composition that is an admixture of LiCl and KCl and has a melting point above about 450° C.

In still yet another embodiment, a process can include providing a precursor system wherein a ceramic tube is adjacent to a composite collar which is adjacent to a cooling collar and applying a cooling fluid to the cooling collar. Thereafter, flowing a molten-catholyte adjacent to a first surface of the ceramic tube and flowing a molten-anolyte adjacent to a second surface of the ceramic tube. In one instance, the molten-catholyte admixes with a portion of the composite collar thereby providing a freeze-composite as a fluidic and non-conductive barrier between the molten-catholyte and the molten-anolyte. In another instance, the molten-anolyte admixes with a portion of the composite collar thereby providing a freeze-composite as a fluidic and non-conductive barrier between the molten-catholyte and the molten-anolyte.

In still another instance, the composite collar, e.g., in the precursor system, includes a salt and a dispersed phase. That is, the precursor system prior to the addition or flowing of the molten-catholyte and/or molten-anolyte includes an admixture of a salt and a dispersed phase. In one example, this admixture can be a combination of salt granules and a fibrous material. In another example, the admixture is a composite of a frozen salt and a fibrous material. The composite collar can be porous or non-porous; in a preferable example, the composite collar is non-porous. In still another example, the composite collar can be provided by saturating a fibrous mass with a molten salt, then cooling the saturated mass to a temperature below the melting point of the salt, thereby freezing the salt and providing a solid composite. Preferably, the molten salt includes LiCl, KCl, or a mixture thereof. In one instance, the molten salt consists essentially of KCl or LiCl; in another instance, the molten salt consists of KCl or LiCl. In a preferable instance, the molten salt has a melting point greater than about 450° C., about 475° C., or about 500° C. In still another preferable instance, the molten salt consists essentially of a LiCl/KCl admixture that has a melting point greater than about 450° C. In a particularly preferable instance, the molten-catholyte and molten-anolyte individually have melting points less than 425° C. and the salt included in the composite collar has a melting point greater than 450° C.

Notably, the fibrous mass can be in the shape necessary for the composite collar or can be another representative shape whereafter the composite collar is cut or formed from the salt-including solid composite.

While the compositions and methods of this invention have been described in terms of preferred embodiments, it will be apparent to those of skill in the art that variations may be applied to the compositions and/or methods in the steps or in the sequence of steps of the method described herein without departing from the concept, spirit and scope of the invention. More specifically, it will be apparent that certain agents that are both chemically and physically related may be substituted for the agents described herein while the same or similar results would be achieved. All such similar substitutes and modifications apparent to those skilled in the art are deemed to be within the spirit, scope and concept of the invention as defined by the appended claims.

What is claimed:

1. An electrolytic system comprising:
- a ceramic tube;
- a cooling collar disposed about and spaced apart from a portion of the ceramic tube; and
- a freeze-composite matrix comprising a salt and a dispersed phase disposed between and in contact with the ceramic tube and the cooling collar;
- wherein, in operation, the cooling collar causes the freeze-composite matrix to form a barrier.

2. The electrolytic system of claim 1, wherein the dispersed phase includes a plurality of inorganic fibers.

3. The electrolytic system of claim 2, wherein the inorganic fibers are selected from a silicate, an aluminate, an aluminosilicate, and a mixture thereof.

4. The electrolytic system of claim 1, wherein the freeze-composite matrix is positioned to separate an anolyte volume from a catholyte volume, thereby preventing ionic and/or electronic conductivity between the anolyte volume and the catholyte volume.

5. The electrolytic system of claim 1, wherein the salt comprises an admixture of lithium chloride and potassium chloride.

6. The electrolytic system of claim 5, wherein the salt includes about 50 wt. % to about 70 wt. % LiCl, and has a melting point of about 350° C. to about 450° C.

7. The electrolytic system of claim 6, wherein the salt consists essentially of lithium chloride and potassium chloride.

8. The electrolytic system of claim 5, wherein the salt has a melting point greater than about 450° C. and includes greater than about 65 wt. % KCl or greater than about 75 wt. % LiCl.

9. The electrolytic system of claim 8, wherein the salt consists essentially of lithium chloride and/or potassium chloride.

10. An electrolytic system comprising:
- a ceramic tube including an outer surface and an inner surface opposite the exterior surface;
- a freeze-composite matrix including a salt and a dispersed phase; and
- a cooling collar disposed about and spaced apart from a portion of the ceramic tube;
- wherein the freeze-composite matrix is disposed between and in contact with the ceramic tube and the cooling collar;
- wherein, in operation, the cooling collar maintains a temperature below the melting point of the salt of the freeze-composite matrix;

a molten-catholyte adjacent to one of the outer surface and the inner surface of the ceramic tube; and a molten-anolyte adjacent to the other of the outer surface and the inner surface of the ceramic tube;

wherein the freeze-composite matrix provides a fluidic and non-conductive barrier between the molten-catholyte and the molten-anolyte.

11. The electrolytic system of claim 10, wherein the molten-catholyte includes an admixture of LiCl and KCl and has a melting point below about 425° C.; and wherein the molten-anolyte includes an admixture of LiCl and KCl and has a melting point below about 425° C.

12. The electrolytic system of claim 11, wherein the salt includes an admixture of LiCl and KCl and has a melting point below about 425° C.

13. The electrolytic system of claim 11, wherein the salt includes LiCl and/or KCl and has a melting point above about 450° C.

* * * * *